US008921289B2

(12) United States Patent
Scherer et al.

(10) Patent No.: US 8,921,289 B2
(45) Date of Patent: Dec. 30, 2014

(54) ESTERS COMPRISING BRANCHED ALKYL GROUPS AS LUBRICANTS

(71) Applicant: Cognis IP Management GmbH, Düsseldorf (DE)

(72) Inventors: Markus Scherer, Mannheim (DE); Dirk Rettemeyer, Hückelhoven (DE)

(73) Assignee: Cognis IP Management GmbH, Duesseldorf (DE)

( * ) Notice: Subject to any disclaimer, the term of this patent is extended or adjusted under 35 U.S.C. 154(b) by 0 days.

(21) Appl. No.: 13/749,084

(22) Filed: Jan. 24, 2013

(65) Prior Publication Data

US 2013/0137614 A1 May 30, 2013

Related U.S. Application Data

(63) Continuation of application No. 12/160,464, filed as application No. PCT/EP2007/000034 on Jan. 4, 2007, now abandoned.

(30) Foreign Application Priority Data

Jan. 12, 2006 (DE) ..... 10 2006 001 768

(51) Int. Cl.

| | |
|---|---|
| ***C10M 129/72*** | (2006.01) |
| ***C10M 105/36*** | (2006.01) |
| ***C10M 105/34*** | (2006.01) |
| ***C10M 129/70*** | (2006.01) |

(52) U.S. Cl.

CPC ..... *C10M 105/36* (2013.01); *C10M 105/34* (2013.01); *C10M 129/70* (2013.01); *C10M 129/72* (2013.01); *C10M 2207/281* (2013.01); *C10M 2207/2815* (2013.01); *C10M 2207/282* (2013.01); *C10M 2207/2825* (2013.01); *C10N 2220/025* (2013.01); *C10N 2220/028* (2013.01); *C10N 2230/10* (2013.01); *C10N 2230/36* (2013.01); *C10N 2230/64* (2013.01); *C10N 2240/04* (2013.01); *C10N 2240/08* (2013.01); *C10N 2240/10* (2013.01); *C10N 2240/14* (2013.01); *C10N 2240/30* (2013.01); *C10N 2240/40* (2013.01)

USPC ..... 508/496; 508/465

(58) Field of Classification Search

USPC ..... 508/496, 465

See application file for complete search history.

(56) References Cited

U.S. PATENT DOCUMENTS

| | | | | |
|---|---|---|---|---|
| 2,757,139 | A | 7/1956 | Matuszak et al. | |
| 5,286,397 | A * | 2/1994 | Schmid et al. | 508/496 |
| 5,488,121 | A | 1/1996 | O'Lenick, Jr. | |
| 5,503,760 | A * | 4/1996 | Bongardt et al. | 508/495 |
| 5,652,201 | A | 7/1997 | Papay et al. | |
| 6,346,504 | B1 | 2/2002 | Appelman et al. | |
| 2006/0204350 | A1 | 9/2006 | Muhl et al. | |

FOREIGN PATENT DOCUMENTS

| | | |
|---|---|---|
| DE | 1269118 | 3/1968 |
| DE | 1594388 | 4/1970 |
| DE | 1594634 | 10/1970 |
| DE | 2302918 | 1/1973 |
| DE | 4202034 | 7/1993 |
| DE | 102004034202 | 11/2005 |
| EP | 0489809 | 8/1990 |
| WO | WO-91/03531 | 3/1991 |
| WO | WO-93/22407 | 11/1993 |
| WO | WO-03/095407 | 11/2003 |

OTHER PUBLICATIONS

Randles, S. J. , "Environmentally Considerate Ester Lubricants for the Automotive and Engineering Industries", *JSL 9-2*. XP000563950, 17 pgs.

Torbacke, M. et al., "Seal Material and Base Fluid Compatibility: An Overview", *J. Synthetic Lubrication 22-2*. XP0009083217 Jul. 2005, 123-142.

Van Der Waal, G. , "The Relationship Between the Chemical Structure of Ester Base Fluids and their Influence on Elastomer Seals, and Wear Characteristics", *JSL* (1). XP-002432827, 280-301.

*Ullmanns Enzykolpadie de Technischen Chemie*, 3rd Edition, vol. 15, pp. 285-294 (1964).

* cited by examiner

*Primary Examiner* — James Goloboy

(74) *Attorney, Agent, or Firm* — Servilla Whitney LLC

(57) ABSTRACT

A process for improving the oxidation stability of lubricants including providing one or more esters containing branched alkyl groups which are reaction products of branched alcohols with a) one or more aliphatic dicarboxylic acids corresponding to general formula (II): HOOC—$R^2$—COOH in which $R^2$ is a branched or unbranched, saturated alkyl group containing 0 to 34 carbon atoms, or b) one or more saturated branched monocarboxylic acids corresponding to general formula (III): $R^3$—COOH in which $R^3$ is a branched alkyl group of 3 to 39 carbon atoms, or c) one or more saturated monocarboxylic acids corresponding to general formula (III) in which $R^3$ is a linear alkyl group of 3 to 29 carbon atoms, or d) a mixture thereof, as lubricants, with the proviso that the esters have an oxidation stability of 1000 hours or more, as determined by the Turbine Oil Stability Test (TOST test) to DIN EN ISO 4263-3.

12 Claims, No Drawings

ESTERS COMPRISING BRANCHED ALKYL GROUPS AS LUBRICANTS

CROSS-REFERENCE TO RELATED APPLICATIONS

This application is a continuation of U.S. patent application Ser. No. 12/160,464 filed Jul. 10, 2008, which is a national stage entry of PCT/EP2007/000034, filed Jan. 4, 2007, which claims priority from German Application No. DE 102006001768.4, filed Jan. 12, 2006, the contents of all of which are incorporated by reference.

FIELD OF THE INVENTION

This invention relates generally to the field of oleochemistry and the use of esters containing branched alkyl groups as lubricants, and, more particularly, to the use of the branched esters, as a carrier medium for hydraulic fluid and to lubricants containing these esters with branched alkyl groups.

BACKGROUND INFORMATION

There is an absolute need to develop biodegradable lubricants for use in machinery which, in the event of leakages through damage, would cause pollution of the environment. This problem has been discussed in many commissions and initiatives. Standards have been defined, including for example VDMA 24 568 or Swedish Standard SS 15 54 34. In addition, product labels, such as "Blauer Engel (Blue Angel)" or "Weisser Schwan (White Swan)", have been devised as a particular mark of environmentally safe products.

Besides high biodegradability, such diverse lubricants as engine oil, turbine oil, hydraulic fluid, transmission oil, compressor oil and the like have to satisfy extremely stringent criteria, such as high viscosity index, good lubricity, high oxidation sensitivity, high thermal stability or other comparable criteria. Development work is currently being carried out on the Europe-wide EU-Ecolabel Standard. Criteria include, inter alia, low toxicity, biodegradability and at least 50% renewable raw materials.

Ester-based lubricating oils are known per se and have been in use for sometime (see Ullmanns Enzyklopädie der technischen Chemie, 3rd Edition, Vol. 15, 1964, pp, 285-294). Common esters are reaction products of dicarboxylic acids with medium-chain alcohols, such as 2-ethyl hexanol for example, or reaction products of polyols, such as trimethylol propane for example, and fatty acids, such as oleic acid for example, or a mixture of n-octanoic and n-decanoic acid. Relatively low viscosities at low temperatures, and hence improved handling behavior at relatively low temperatures have been described in particular for esters with branched alkyl chains. Such esters are, for example, reaction products of Guerbet alcohols with dicarboxylic acids which are described as a component of lubricants in EP 489 809.

In addition, DE 2302918 describes ester oils of polyols with branched acids which show improved viscosity temperature behavior in relation to lubricants based on mineral oils. Moreover, it is known from U.S. Pat. No. 5,488,121 for example, that esters of Guerbet alcohols and Guerbet acids, so-called di-Guerbet esters, lead to lubricants distinguished by high oxidation stability and good viscosity/temperature properties.

It is also known that esters with completely saturated side chains show increased oxidation stability. A particular problem arises when, in addition to high oxidation stability and low low-temperature viscosity, the lubricants are expected to show improved compatibility with sealing materials. This problem applies above all to readily biodegradable hydraulic fluids. The known lubricants based on linear esters with high oxidation stability are saturated in character, but cause softening of the usual sealing materials. Conversely, unsaturated esters emanating from oleic acid, for example, show better behavior towards sealing materials, but greatly reduced oxidation stability. Particular problems arise with such sealing materials as NBR (nitrile/butyl rubber) and hydrogenated variants thereof (HNBR).

An Article by Torbacke et al. ("Synthetic Lubrication" (2005), 22(2), 123-142) investigates the compatibility with sealing materials of lubricants based on esters, such as monoesters, polyol esters, diesters and complex esters, by comparison with mineral oils.

There is still a need for improved lubricants with high biodegradability.

SUMMARY OF THE INVENTION

Briefly described, a process for improving the oxidation stability of lubricants includes providing one or more esters containing branched alkyl groups which are reaction products of branched alcohols corresponding to general formula (I): $R^1OH$ in which $R^1$ is a branched alkyl group obtaining 10 to 40 carbon atoms, with a) one or more aliphatic dicarboxylic acids corresponding to general formula (II): HOOC—$R^2$—COOH in which $R^2$ is a branched or unbranched, saturated alkyl group containing 0 to 34 carbon atoms, or b) one or more saturated branched monocarboxylic acids corresponding to general formula (III): $R^3$—COOH in which $R^3$ is a branched alkyl group of 3 to 39 carbon atoms, or c) one or more saturated monocarboxylic acids corresponding to general formula (III) in which $R^3$ is a linear alkyl group of 3 to 29 carbon atoms, or d) a mixture of at least two of the compounds of groups a) to c), as lubricants, with the proviso that the esters containing branched alkyl groups have an oxidation stability of 1000 hours or more, as determined by the Turbine Oil Stability Test (TOST test) to DIN EN ISO 4263-3.

DETAILED DESCRIPTION OF THE INVENTION

The problem addressed by the present invention was to provide lubricants which, in addition to ready biodegradability, would show high oxidation stability and, at the same time, high compatibility with sealing materials and which, generally, would be obtainable from renewable raw materials. The other properties of the lubricants, particularly their lubricity and theological properties, would not be adversely affected.

It has been found that certain esters solve the problem stated above.

The present invention relates to the use of esters containing branched alkyl groups which are reaction products of alcohols corresponding to general formula (I):

$$R^1OH \quad (I)$$

in which $R^1$ is a branched alkyl group containing 10 to 40 carbon atoms, with a) aliphatic dicarboxylic acids corresponding to general formula (II):

$$HOOC—R^2—COOH \quad (II)$$

in which $R^2$ is a branched or unbranched, saturated alkyl group containing 0 to 34 carbon atoms, or b) saturated monocarboxylic acids corresponding to general formula (III):

$$R^3—COOH \quad (III)$$

in which $R^3$ is a branched alkyl group of 3 to 39 carbon atoms, or c) saturated monocarboxylic acids corresponding to general formula (III) in which $R^3$ is a linear alkyl group of 3 to 29 carbon atoms, or d) a mixture of at least two of the above-mentioned acid groups a) to c), as lubricants, with the proviso that the esters containing branched alkyl groups have an oxidation stability of 1000 hours or more in an oxidation stability test, for example in the turbine oil stability test (TOST test) to DIN EN ISO 4263-3, and show compatibility with sealing materials (for example, to ASTM D 471).

Particular preference is attribute to the us(c) of esters containing branched alkyl groups which are reaction products of alcohols corresponding to general formula (I):

$$R^1OH \quad (I)$$

in which $R^1$ is a branched alkyl group containing 10 to 40 carbon atoms, with aliphatic dicarboxylic acids corresponding to general formula (II):

$$HOOC—R^2—COOH \quad (II)$$

in which $R^2$ is a branched or unbranched, salivated alkyl group containing 0 to 34 carbon atoms.

In another embodiment of the invention, the esters containing branched alkyl groups to be used also meet the requirement that they should have a biodegradability of 60% or higher and/or that the percentage content of renewable raw materials in the lubricant is 50% by weight or more.

These reaction products and the raw materials from which they are produced are compounds know per se.

The branched alcohols may he branched at any position of the alkyl chain except for C1 and are preferably branched at position C2. The branched alcohols are preferably Guerbet alcohols or Guerbet alcohol mixtures. The preferred Guerbet alcohols are those obtainable by guerbetization of fatty alcohols containing 8 to 12 carbon atoms. The trivial name Guerbet alcohols applies to 2-alkyl-substituted 1-alkanols of which the industrial-scale synthesis is adequately described in the literature. It comprises the condensation of primary linear alcohols in the presence of basic catalysts via the intermediate stages of the aldehydes and aldols.

The branching of the alcohols containing a $C_{10-40}$ alkyl group consists of an alkyl group containing 3 to 20 carbon atoms. The sum total of carbon atoms in the branched alkyl group as a whole consists of the alkyl chain and the $C_{3-20}$ alkyl group of the branch and amounts to 10 to 40 carbon atoms. Alcohols containing a branched alkyl group with 6 to 38 carbon atoms are preferred, those containing a branched alkyl group with 8 to 32 carbon atoms are particularly preferred, and those containing a branched alkyl group with 16 to 24 carton atoms are most particularly preferred.

According to the invention, preference is attributed to the branched $C_{10-40}$ alcohols selected from the group consisting of 2-propyl heptanol, 2-butyl octanol, 2-pentyl nonanol, 2-hexyl decanol, 2-heptyl undecanol, 2-octyl dodecanol, 2-nonyl tridecanol, 2-decyl tetradecanol, 2-undecyl pentadecanol, 2-dodecyl hexadecanol, 2-tridecyl heptadecanol, 2-tetradecyl octadecanol, 2-pentadecyl nonadecanol, 2-hexadecyl eicosanol and 2-heptadecyl heneicosanol.

Among the preferred alcohols, 2-hexyl decanol (C 16), 2-heptyl undecanol (C 18), 2-octyl dodecanol (C 20), 2-nonyl tridecanol (C 22) and 2-decyl tetradecanol (C 24) are particularly preferred, 2-hexyl decanol (C 16), 2-heptyl undecanol (C 18) and 2-octyl dodecanol (C 20) being most particularly preferred.

Possible manufacturers from whom the products usable in accordance with the invention may be obtained include BASF, Sasol and Cognis GmbH & Co. KG. Suitable Cognis product are those listed, for example, under the names of Eutanol G 16, Eutanol G or Guerbitol 16/20.

The dicarboxylic acids corresponding to formula (II) are known per se and are commercially obtainable. Suitable dicarboxylic acids (II) are saturated dicarboxylic acids, such as oxalic acid, malonic acid, succinic acid, glutaric acid, adipic acid, pimelic acid, suberic acid, azalaic acid, sebacic acid, brassylic acid, thapsic acid and phellogenic acid. The anhydrides of the dicarboxylic acids are also suitable for reaction in accordance with the invention. Azelaic acid and sebacic acid and their anhydrides are particularly preferred.

The saturated monocarboxylic acids of formula (III) are also known per se and are commercially obtainable. Both branched saturated monocarboxylic acids containing 4 to 40 carbon atoms and linear saturated monocarboxylic acids containing 4 to 30 carbon atoms are suitable. Typical examples are selected from the group consisting of 2,2-dimethylpropanoic acid, neoheptanoic acid, neooctanoic acid, neononanoic acid, isohexanoic acid, neodecanoic acid, 2-ethylhexanoic acid, 3,5,5-trimethyl hexanoic acid, isoheptanoic acid, iso-octanoic acid, isononanoic acid, isostearic acid, isopalmitic acid and isodecanoic acid and from the group consisting of butyric acid, valeric acid, caproic acid, heptanoic acid, caprylic acid, pelargonic acid, capric acid, undecanoic acid, lauric acid, tridecanoic acid, tetradecanoic acid, pentadecanoic acid, palmitic acid, margaric acid, stearic acid, nonadecanoic acid, arachic acid, behenic acid, lignoceric acid, myristic acid, cerotic acid, melissic acid, tricosanoic acid, Guerbet acid C 32 (reaction product of the guerbetization of palmitic acid), Guerbet acid C 34 (reaction product of the guerbetization of palmitic acid with stearic acid) or Guerbet acid C 36 (reaction product of the guerbetization of stearic acid) and pentacosanoic acid. Isostearic acid and isopalmitic acid are particularly preferred.

The reaction leading to the reaction products is carried out by syntheses known per se for the production of esters.

One particular embodiment is characterized by the use of esters containing branched alkyl groups which have a kinematic viscosity at 40° C. (DIN 51562) of 3 to 500 $mm^2/s$ and preferably in the range from 10 to 120 $mm^2/s$.

For the purposes of the present invention, the oxidation stability of the esters is determined in a standard test to DIN EN ISO 4263-1, which is also known as the turbine oil stability test (TOST test), or updated versions thereof, more particularly the DIN EN ISO 4263-3 test. At the time the test was carried out, the DIN EN ISO 4263-3 test in particular was still at the draft stage. However, the objection deadline expired on Oct. 10, 2004. Oxidation stability was determined between saturated linear, saturated branched and unsaturated linear esters.

The branched esters to be used in accordance with the invention have an oxidation stability of more than 1000 hours. The branched esters according to the invention preferably have an oxidation stability determined by the test of more than 2000 hours and, in particular, more then 4000 hours.

It was shown that an oxidation stability of more than 4000 hours can only be achieved by very few saturated esters. Unsaturated esters have an oxidation stability of less than 1000 hours. The increased oxidation stability results in an extended life and usability of the branched ester as a lubricant.

Another property of the esters to be used in accordance with the invention is their high hydrolysis stability. This was determined by measuring the acid value in a 12-day reaction with water at 100° C. The acid value (as measured to DIN ISO 660) of the branched esters to be used in accordance with the invention after the 12-day test is preferably 1 or lower and, more particularly, 0.5 or lower.

In addition to high hydrolysis stability and oxidation stability, the branched esters to be used in accordance with the invention show high compatibility with the sealing materials which are normally used. The test for compatibility with sealing materials can be carried out, for example, to the Standard ASTM D 471, for example, over 168 hours at 100° C. In this test, the branched esters to be used in accordance with the invention produce an increase in volume in the sealing materials of at most 20% and preferably at most 10%, a loss of hardness of less than 15% and preferably less than 10%, and a reduction in breaking elongation of less than 50% and preferably less than 30%.

Stability problems affecting sealing materials through contact with ester-based lubricants arise in particular in cases where nitrile/butadiene or acrylonitrile/butadiene or hydrogenated variants thereof are used. Typically, these sealing materials are softened by esters as lubricants which is reflected in an increase in volume. This softening leads to reduced hardness and reduced tensile strength or breaking elongation.

In a preferred embodiment of the invention, the esters with branched alkyl groups to be used are compatible with sealing materials selected from the group consisting of NR (natural rubber), NBR (nitrile/butadiene rubber), HNBR (hydrogenated nitrite/butyl rubber), FPM (fluorinated rubber), ACM (acrylate rubber), PTFE (Teflon), PU (polyurethane), silicone, polyacrylate and neoprene and, in a particularly preferred embodiment, with sealing materials of NBR, HNBR and ACM.

In a preferred embodiment of the use according to the invention, the stability of the sealing materials towards esters containing branched alkyl groups is determined by the above-mentioned ASTM D 471 test and the criteria mentioned are fulfilled.

Another particularly preferred property of the esters to be used in accordance with the invention or lubricants containing the esters with branched alkyl groups is their good biological degradability. This is determined, for example, by the standard OECD 301 test or by the EPA 560/6-82-003 test, and preferably by OECD test 301 B. In these tests, the esters containing branched alkyl groups to be used must show a biological degradability of at least 60%, preferably at least 70% and, more particularly, at least 75%.

In addition, at least 50% by weight of the esters containing branched alkyl groups used in accordance with the invention or of lubricants containing the esters with branched alkyl groups should consist of renewable raw materials. In a particularly preferred embodiment, the percentage content of renewable raw materials is 70% by weight or more and, more particularly, 90% by weight or more. In the context of the invention, renewable raw materials are compounds obtained from naturally occurring raw materials either by direct isolation or by processing, for example by esterification. Such naturally occurring raw materials include, for example, plants and animal fats.

In another preferred embodiment, the esters containing branched alkyl groups to be used have a flash point above 200° C., and preferably above 250° C. Accordingly, the esters containing branched alkyl groups according to the invention may also be used as a basic liquid for fire-resistant lubricants and, more particularly, as a carrier medium for fire-resistant hydraulic fluids and especially for the production of fire-resistant hydraulic fluids belonging to the HFDU class.

In another embodiment of the invention, the esters containing branched alkyl groups in the form of the above-mentioned reaction products, with the provisos that they have an oxidation stability of more than 1000 hours and are compatible with sealing materials, are used as a basis for lubricating oils, as a carrier medium for hydraulic fluid, as a carrier medium for cooling lubricating fluid, as a carrier medium for industrial transmission oil, as a carrier medium for compressor oil, as a carrier medium for turbine oil, as a carrier medium for engine oil, as a carrier medium for axle oil, as a carrier medium for shook absorber fluid or as a carrier medium for automotive transmission oil. The esters containing branched alkyl groups are preferably used as a carrier medium for hydraulic fluid and especially for the production of hydraulic fluids belonging to ISO Classes ISO VG 10, VG 22, VG 32, VG 46, VG 68 and VG 100.

In the context of the invention, lubricants include in particular the above-mentioned lubricating oils, fluids, lubricating fluids and oils. However, the invention is not confined to the use of these particular lubricants.

In a preferred embodiment of the use, the esters containing branched alkyl groups are present in the lubricant in quantities of 0.1 to 100% by weight, baaed on the total quantity of lubricant, and preferably in a quantity of 5 to 99% by weight. In the case of hydraulic fluid, they are preferably present in a quantity of 95 to 99.5% by weight.

Accordingly, another embodiment of the use is characterized in that other lubricants selected from the group consisting of mineral oils, highly refined mineral oils, alkylated mineral oils, poly-α-olefins, polyalkylene glycols, phosphate esters, silicone oils, diesters and esters of polyhydric alcohols and also mineral oils of the "solvent neutral" class and XHVI, VHVI, group II and group III mineral oils may be present in the lubricant.

In addition to the other lubricating fluids mentioned, the lubricant used in accordance with the invention may contain other additives selected from the group consisting of thickeners, viscosity index modifiers, antioxidants, corrosion inhibitors, demulsifiers, defoamers, dyes, anti-wear (AW) additives, extreme pressure (EP) additives and friction modifiers.

Accordingly, the present invention also relates to lubricants which contain esters with branched alkyl groups that fulfill the criteria of oxidation stability and compatibility with sealing materials in quantities of 0.1 to 99.5% by weight, based on the total quantity of lubricant. The lubricants again preferably contain 5 to 99% by weight and, in the case of hydraulic fluids, a quantity of 95 to 99.5% by weight of esters containing branched alkyl groups. The lubricants may also contain the other lubricating fluids and/or additives mentioned, the sum of the quantities amounting to 100% by weight.

EXAMPLES

Example 1

Oxidation Stability Test

Oxidation stability test (TOST=Turbine Oxidation Stability Test), DIN EN ISO 4263-3.

To determine oxidation stability, various esters were subjected to the turbine oxidation stability test (TOST, DIN EN ISO 4263-3). The results are set out in Table 1 (where "h"=hours).

The esters used are characterized as follows;

E1: Example 1, saturated branched ester of 2-octyl dodecanol with azelaic acid.

CE1: Comparison Example 1, saturated linear ester of trimethylol propane (TMP) and linear C8/C10 acid (obtainable, for example, under the product name of Synative ES 3157).

CE2: Comparison Example 2, unsaturated linear ester of trimethylol propane (TMP) and oleic acid (obtainable, for example, under the product name of Synative ES TMP 05).

96.8% of the hydraulic fluids tested consist of the esters mentioned. The additive mixture used accounted for 3.2% of each product and satisfied the standard requirements which ready-formulated hydraulic oils are expected to meet. The additives present included antioxidants, corrosion inhibitors for nonferrous metals and steel, additives for modifying air separation behavior, foam behavior and demulsifying power and EP/AW additives.

TABLE 1

Oxidation stability of various esters

| Hydraulic fluid with E1 | Hydraulic fluid with CE1 | Hydraulic fluid with CE2 |
|---|---|---|
| >4000 h | > 4000 h | 300 h |

It can be seen that the hydraulic fluid containing CE2 based on the unsaturated ester has a significantly lower oxidation stability in relation to saturated esters and could not therefore be used for the purposes of the invention.

Example 2

Compatibility Test with Sealing Materials

To determine the stability of sealing materials towards the esters to be used in accordance with the invention, the standard ASTM D 471 test was carried out over 168 hours at 100° C. The sealing material was monitored for changes in volume, hardness and breaking elongation behavior. NBR 1(nitrile/butadiene rubber, DIN ISO 6072:2002 E) and the esters mentioned in Example 1 were used as sealing materials.

The results are set out in Table 2.

TABLE 2

Compatibility with NBR as sealing material

| | Specification to ASTM D 471 | Hydraulic fluid with E1 | Hydraulic fluid with CE1 | Hydraulic fluid with CE2 |
|---|---|---|---|---|
| Volume | 3/+20% | 0.4 | 20.5 | 9.5 |
| Hardness | +10/−15 PTS | −1.4 | −8.3 | −4.5 |
| Elongation | 50% max. | −7 | <−50 | −11 |
| Breaking elongation | 50% max. | −23 | <−70 | −26 |

It can be seen that hydraulic fluid E1 containing the saturated ester with branched alkyl groups achieved excellent results in regard to change in volume and also satisfied all the other criteria. By contrast, the hydraulic fluid containing CE1 produced poor results despite its favorable oxidation behavior.

Example 3

Biological Degradability

The following results were achieved in standard tests for water pollution potential, toxicity, biodegradability and percentage content of renewable raw materials for ester E1, ISO VG 46.

TABLE 3

Toxicity and biodegradability of the esters containing saturated, branched alkyl groups

| | Method | Spec. | Hydraulic fluid with B1 |
|---|---|---|---|
| Water pollution | German classification | WGK 1 | WGK 1 |
| Toxicity (fish) | OECD 203 | LC 50 > 1000 mg/l water | >1000 |
| Biodegradability | OECD 301 (B, C, D) | >60% | >60 |
| Biodegradability | EPA 560/6-82-003 | >60% | >60 |
| Percentage renewables | | >50% [% by wt.] | >90% |

If can be seen that the ester did not exceed any of the prescribed limits of the standard tests.

What is claimed:

1. A process for improving the oxidation stability of lubricants comprising providing a lubricant comprising one or more esters containing branched alkyl groups which are reaction products of a Guerbet alcohol having 20 carbon atoms with azelaic acid and at least one additional fluid selected from the group consisting of mineral oils, highly refined mineral oils, alkylated mineral oils, poly-α-olefins, polyalkylene glycols, phosphate esters, silicone oils, diesters and esters of polyhydric alcohols, solvent neutral mineral oils, and XHVI, VHVI, Group II and Group III mineral oils, with the proviso that the lubricant has an oxidation stability of 1000 hours or more, as determined by the Turbine Oil Stability Test (TOST test) according to DIN EN ISO 4263-3; wherein the esters containing branched alkyl groups are present in quantities of 95 to 99.5% by weight, based on the total quantity of lubricant.

2. The process according to claim 1, wherein the esters containing branched alkyl groups have a biodegradability of 60% or higher.

3. The process according to claim 1, wherein the percentage content of renewable raw materials in the lubricant is 50% by weight or more.

4. The process according to claim 1, wherein the esters containing branched alkyl group have a kinematic viscosity at 40° C. (DIN 51562) of 3 to 500 $mm^2/s$.

5. The process according to claim 1, wherein the esters containing branched alkyl groups have a kinematic viscosity at 40° C. (DIN 51562) of 10 to 120 $mm^2/s$.

6. The process according to claim 1, wherein the esters containing branched alkyl groups have an oxidation stability of more than 2000 hours, as determined by the Turbine Oil Stability Test (TOST) according to DIN EN ISO 4263-3.

7. The process according to claim 1, wherein the esters containing branched alkyl groups are compatible with sealing materials selected from the group consisting of natural rubber, nitrile/butadiene rubber, hydrogenated nitrile/butyl rubber, fluorinated rubber, acrylate rubber, polytetrafluoroethane, polyurethane, silicone, polyacrylate, and neoprene.

8. The process according to claim 7, wherein the compatibility of the esters containing branched alkyl groups with sealing materials is determined according to ASTM D 471, and the sealing materials exhibit an increase in volume of at most 20%, a loss of hardness of less than 15% and a reduction in breaking elongation of less than 50%.

9. The process according to claim 1, wherein the esters containing branched alkyl groups provide a basis for lubricating oils or a carrier medium for hydraulic fluid, cooling lubricating fluid, industrial transmission oil, compressor oil, turbine oil, engine oil, axle oil, shock absorber fluid or automotive transmission oil.

10. The process according to claim 1, wherein one or more additives selected from the group consisting of thickeners, viscosity index modifiers, antioxidants, corrosion inhibitors, demulsifiers, defoamers, dyes, anti-wear (AW) additives, extreme pressure (EP) additives and friction modifiers are present.

11. A lubricant comprising one or more esters containing branched alkyl groups which are reaction products of a Guerbet alcohol having 20 carbon atoms with azelaic acid in quantities of 95 to 99.5% by weight, based on the total quantity of lubricant.

12. The lubricant of claim 10 further comprising at least one additional fluid selected from the group consisting of mineral oils, highly refined mineral oils, alkylated mineral oils, poly-α-olefins, polyalkylene glycols, phosphate esters, silicone oils, diesters and esters of polyhydric alcohols, solvent neutral mineral oils, and XHVI, VHVI, Group II and Group III mineral oils.

* * * * *